US006526856B2

(12) United States Patent
Newnes

(10) Patent No.: US 6,526,856 B2
(45) Date of Patent: Mar. 4, 2003

(54) BOARD TRIMMER WITH PRE-TRIMMER NEAR-END SAWS

(75) Inventor: William R. Newnes, Salmon Arm (CA)

(73) Assignee: CAE, Inc. (CA)

( * ) Notice: Subject to any disclaimer, the term of this patent is extended or adjusted under 35 U.S.C. 154(b) by 0 days.

(21) Appl. No.: 09/912,630

(22) Filed: Jul. 24, 2001

(65) Prior Publication Data

US 2002/0007710 A1 Jan. 24, 2002

Related U.S. Application Data

(60) Provisional application No. 60/220,176, filed on Jul. 24, 2000.

(51) Int. Cl.[7] ..... B27B 5/04; B27B 1/00; B27C 9/00

(52) U.S. Cl. ..... 83/423; 83/75.5; 83/425.4

(58) Field of Search ..... 83/425.4, 75.5, 83/732, 712, 423, 418, 415, 431, 733, 734, 155, 157, 411.5, 411.6, 411.3, 411.4

(56) References Cited

U.S. PATENT DOCUMENTS

| | | | | | |
|---|---|---|---|---|---|
| 2,332,654 | A | | 10/1943 | Mead et al. | |
| 2,403,673 | A | | 7/1946 | Mead | |
| 2,641,288 | A | | 6/1953 | Blickenderfer et al. | |
| 3,036,605 | A | | 5/1962 | Joa | |
| 3,063,479 | A | | 11/1962 | Prentice | |
| 3,885,483 | A | * | 5/1975 | Ikeya et al. | 144/356 |
| 4,031,790 | A | | 6/1977 | Arvidsson | |
| 4,093,007 | A | * | 6/1978 | Hellstrom | 144/2.1 |
| 4,120,333 | A | * | 10/1978 | Hellgren et al. | 144/242.1 |
| 4,164,248 | A | * | 8/1979 | Rysti | 144/2.1 |
| 4,294,149 | A | * | 10/1981 | Olsson | 144/242.1 |
| 4,364,311 | A | * | 12/1982 | Platt lll | 100/26 |
| 4,726,724 | A | * | 2/1988 | Jenkner | 271/130 |
| 4,960,023 | A | * | 10/1990 | Reuter et al. | 83/368 |
| 5,094,654 | A | | 3/1992 | Strom | |
| 5,142,955 | A | * | 9/1992 | Hale | 144/356 |
| 5,205,705 | A | * | 4/1993 | Jenkner | 144/245.7 |

* cited by examiner

*Primary Examiner*—Raleigh W. Chu
*Assistant Examiner*—Nini F. Legesse
(74) *Attorney, Agent, or Firm*—John S. Reid; Reidlaw, L.L.C.

(57) ABSTRACT

A board trimmer having pre-trimmer saws includes a selectively translatable upstream first pre-trimmer saw mounted on a near-side of a board flow path of a board transfer, upstream of a downstream multi-saw board trimmer. The pre-trimmer saw is selectively translatable by an actuator for translation linearly parallel to a near-side ended board on the board transfer. The pre-trimmer saw is perpendicular to the board when on the board transfer. A board elevator may be mounted below the board flow path and the pre-trimmer saw for elevating the board from a sequence of single boards from the board transfer into sawing engagement with the pre-trimmer saw once the pre-trimmer saw has been pre-positioned by the actuator into an optimized cutting path. Trimming of the board in the flow path is done according to an optimized solution for trimming the board. The board may be optimally trimmed by a combination of trimming a first waste portion from a near-end of the board by the first pre-trimmer saw and by trimming a second waste portion from either or both of the near-end and a far end of the board by the downstream multi-saw trimmer.

19 Claims, 5 Drawing Sheets

10
12
12
14
14a
14b
14c
14
14a
14a
14b
18
20
22
22
24
24
25
26
30
30'
36
36
38
40
42
42
42
42
44
46
46
46
46
46'
46'
46'
46'
A
B
B
C
C

BOARD TRIMMER WITH PRE-TRIMMER NEAR-END SAWS

CROSS REFERENCE TO RELATED APPLICATIONS

The present application claims priority to U.S. Provisional Patent Application Ser. No. 60/220,176, filed Jul. 24, 2000.

FIELD OF THE INVENTION

This invention relates to a high speed board trimmer and in particular to a trimmer having upstream near-end pre-trimming saws.

BACKGROUND OF THE INVENTION

Much effort in the past has focused on improving lumber sawing methods to optimize board production and reduce wastage. For example, after a cant has been sawn into boards, the boards may be left with wane, defects, weakened areas or other imperfections at the ends of the boards which must be trimmed off. On high speed transfer it has proven difficult in the prior art to accurately trim such boards.

In the prior art it is known to employ trimmers having a single laterally spaced array of drop-down saws, for example on two foot centers, where each of the drop-down saws in the array is equally spaced from adjacent saws and is individually selectively actuable. The trimmer may be immediately downstream of a fixed or active fence for prepositioning a board relative to the array of saws for approximately optimized trimming of defects from ends of the board. In the prior art it is also know to laterally shift the array of drop-down saws in the trimmer, for example as a substitute for, or in addition to, the use of, an active fence for optimizing positioning of the board relative to the saws prior to trimming by one or more of the drop-down saws. One problem in using drop-down saws in a high speed transfer has been the mechanical limitations on how quickly a drop-down saw may be actuated so as to drop into, and to be elevated from, the flow path of boards on the board conveyor.

In the prior art Applicant is also aware of U.S. Pat. No. 5,142,955 which issued Sep. 1, 1992 to Hale for a Lumber Cutter for Removing End Defects and Sawing to Desired Lengths in which is disclosed a root end trim saw extending over a root end edge of a plurality of chain belt conveyers transverse to a longitudinal dimension of boards on the conveyer, the root end trim saw including a motor driven rotating circular saw blade articulated to move down into, or up out of the path of lumber pieces on the conveyer and also slidably mounted to be moved over a range of approximately 24 inches in one half inch increments to thereby cut away a defective portion of a lumber piece identified by a scanner. In applicant's view, because the saw of Hale has to be both articulated vertically and translated laterally, difficulty would be encountered in timely pre-positioning the saw and cutting lumber accurately in a high speed transfer of boards downstream into a trimmer.

Consequently, it is one object of the present invention to provide a pre-trimmer circular saw which may be rapidly pre-positioned for a particular board in the board flow to accurately pre-trim a near-end of the board as it is translated downstream on a trimmer in-feed transfer and then retracted out of the flow path or re-positioned for a subsequent board so as to allow trimming of the boards in the trimmer with improved accuracy.

A further objective is to provide a method of trimming the near-end of a scanned board by the use of a board elevator to elevate each board so as to engage a pre-trim saw as necessary for optimized trimming by a downstream trimmer.

SUMMARY OF THE INVENTION

The lumber trimmer with pre-trimmer saws of the present invention is mounted within a green or dry lumber line having an upstream scanner and upstream transverse ending rolls. The scanner scans each board and the scanned board data is processed by an optimizer to provide an optimized trimming solution for each board. The optimizer determines an optimum trimmed length and relative position trimmed board segment relative to each board so as to recover the highest value length of lumber, based, for example, on one or two foot increments between trimmer saws, which is practicable to retrieve within a "good wood" boundary established by the optimizer. The optimizer then calculates a lateral translation distance for an upstream pre-trimmer saw located between the scanner and a downstream multi-saw drop-saw trimmer to allow accurate recovery of "good wood" by the multi-saw trimmer. The ending rolls, or other board ending means such as in-line "skate" wheels end boards transversely across a flow path so as to end the near ends of the boards against a fixed fence positioned at the near side of an upstream end of the multi-saw trimmer. The fixed fence is of sufficient length to allow for dampening of lumber bounce-back. The pre-trimmer saw or plurality of such saws comprise one or more selectively laterally positionable near-end saws mounted at the near side of said flow path, for example upstream of the fence and upstream of the trimmer. The pre-trimmer saws are positioned by selectively actuable actuators so as to position the saws in a direction transverse to the lumber flow path and parallel to transversely aligned boards on lugged transfer chains translating the boards along the flow path. The boards may be individually elevated on a board elevator, so as to be near-end trimmed by the pre-trimmer saws. The board elevator may be, for example, a plurality of lugged discs or wheels in laterally spaced array beneath the pre-trimmer saws, spaced transversely across said flow path. Other board elevators such as speed-up chains, or belts, or slides would work. This allows for a higher board transfer rate than for example might be obtained using the Hale device which vertically actuates saws into and out of the board flow path.

In summary the board trimmer having pre-trimmer saws of the present invention includes a selectively translatable upstream first pre-trimmer saw mounted on a near-side of a board flow path of a board transfer, upstream of a downstream multi-saw board trimmer. The pre-trimmer saw is selectively translatable by an actuator for translation linearly parallel to a near-side ended board on the board transfer. The pre-trimmer saw is perpendicular to the board when on the board transfer. A board elevator may be mounted below the board flow path and the pre-trimmer saw for elevating the board from a sequence of single boards from the board transfer into sawing engagement with the pre-trimmer saw once the pre-trimmer saw has been pre-positioned by the actuator into an optimized cutting path. Trimming of the board in the flow path is done according to an optimized solution for trimming the board. The board may be optimally trimmed by a combination of trimming a first waste portion from a near-end of the board by the first pre-trimmer saw and by trimming a second waste portion from either or both of the near-end and a far end of the board by the downstream multi-saw trimmer.

In one embodiment the board elevator is a rotatable disc, or array of such discs, having mounted thereon a means for carrying the board fixed, i.e. immobile, relative to the disc as the disc rotates in a direction corresponding to the flow path and the board is carried over the disc, where the disc is parallel to the pre-trimmer saw and rotatably mounted below the board transfer so that only an upper periphery of the disc extends above the board transfer. The upper periphery rotates in the direction corresponding to the flow path. In the case where the board elevator is an array of the rotatable discs, the array of the rotatable discs extends across the flow path, parallel to a board on the board transfer.

A selectively translatable second pre-trimmer saw may be mounted parallel to, and downstream of, the first pre-trimmer saw. The second pre-trimmer saw is selectively translatable parallel to the selective translation of the first pre-trimmer saw. The board elevator may also be below the second pre-trimmer saw. Thus in one embodiment the board elevator may include both a first rotatable disc corresponding to the first pre-trimmer saw and a second rotatable disc corresponding to the second pre-trimmer saw. The first and second rotatable discs may both have mounted thereon a means for carrying the board fixed relative to the first or second rotatable discs respectively. The discs may be parallel to the pre-trimmer saws and rotatably mounted below the board transfer so that only an upper periphery of the discs extend above the board transfer, the upper periphery of both discs rotating in the direction corresponding to the flow path.

The board elevator may also be a first array of spaced-apart rotatable discs and a second downstream array of spaced-apart rotatable discs, the first and second arrays corresponding to the first and second pre-trimmer saws for elevating a board into the first or second pre-trimmer saws respectively. The first and second arrays may extend across the flow path, parallel to each other and to a board when on the board transfer.

The means for carrying a board fixed relative to a disc may be at least one lug or protrusion (collectively referred to as a lug) extending radially outwardly of the disc so as to extend upwardly from the upper periphery of the disc during rotation of the disc. The lug rotates on the disc into engagement with an upstream side of the board as the board is carried over the disc. The at least one lug may be a pair of oppositely disposed lugs.

A selectively laterally translatable ending saw may be provided downstream of the first pre-trimmer saw and mounted on the near-side of the board flow path to act in combination with the pre-trimmer saw or saws. The ending saw is selectively actuable by an ending saw actuator to extend the ending saw into the flow path to trim a selectively optimized end portion from the board as the board passes towards, through or away from the multi-saw saw trimmer. The ending saw cooperates with the pre-trimmer saw or saws to allow for optimized trimming of a far-end waste portion, opposite to the near-end waste portion, from the board during selective sawing by saws of the multi-saw board trimmer, wherein the board is a near-side ended board. The board is near-side ended between the pre-trimmer saw or saws and the ending saw.

A board is first ended by a first board ending means mounted upstream of the first pre-trimmer saw. A second board ending means is mounted between the pre-trimmer saw or saws and the ending saw so as to cooperate with boards in the flow path, to near-side end them before they engage the ending saw.

DETAILED DESCRIPTION OF EMBODIMENTS OF THE INVENTION

Figures 1, 2, 3:
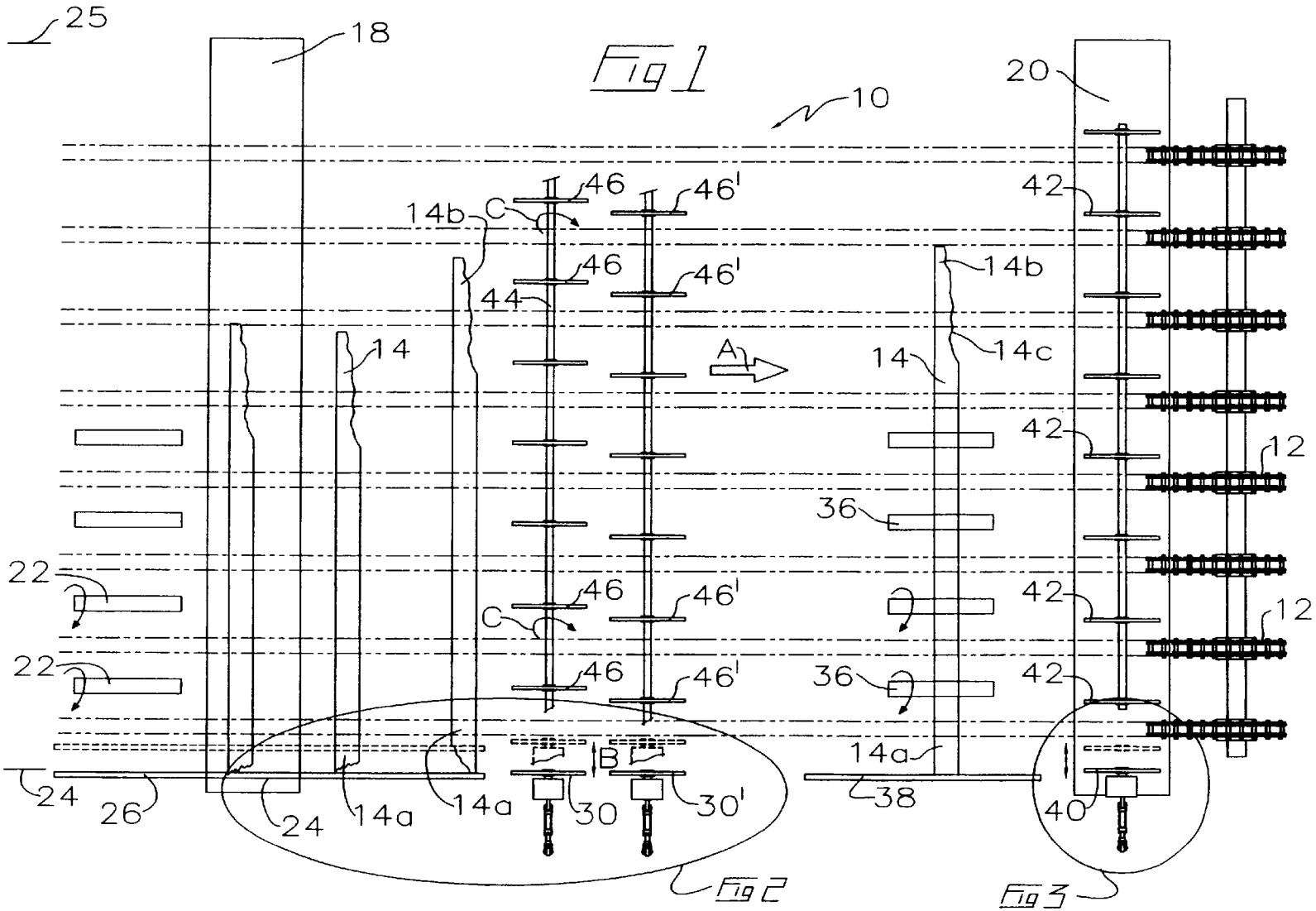
FIG. 1 is a plan view of a board transfer between a scanner and a multi-saw trimmer.
FIG. 2 is an enlarged portion of FIG. 1.
FIG. 3 is an enlarged portion of FIG. 1.

As seen in FIGS. 1–3, high speed trimmer 10 includes a series of endless lugged chains 12 which transport lumber boards or pieces 14 in direction A. Reference to boards or lumber pieces are used interchangeably herein to denote workpieces to be trimmed. Chains 12 may translate at speeds in excess of 100 lugs per minute. An upstream scanner 18 scans lumber pieces 14 as they are transported along trimmer 10 by chains 12 and communicates corresponding scanned data to an optimizer (not shown).

Upstream transverse ending rolls 22 end the individual lumber pieces 14 against a fixed fence 26 on the near side lumber line 24 of the trimmer 10. Far side lumber line 25 is determined by the length of the longest board that may be accommodated as lumber pieces 14 by trimmer 10. Fence 26 is of a sufficient length to allow dampening of lumber bounce-back of the boards after the boards initial contact with fence 26.

Immediately downstream of fence 26 and scanner 18 is one or more near-end pre-trimming saws 30, two being illustrated by way of example. When the optimizer determines from the scanned data that the near-end 14*a* of a board 14 has an end defect which requires trimming, a trim saw 30 is positioned in direction B relative to fence 26 so that when the board 14 is carried past trim saw 30, the end defect is trimmed off as better described below.

Figure 4:
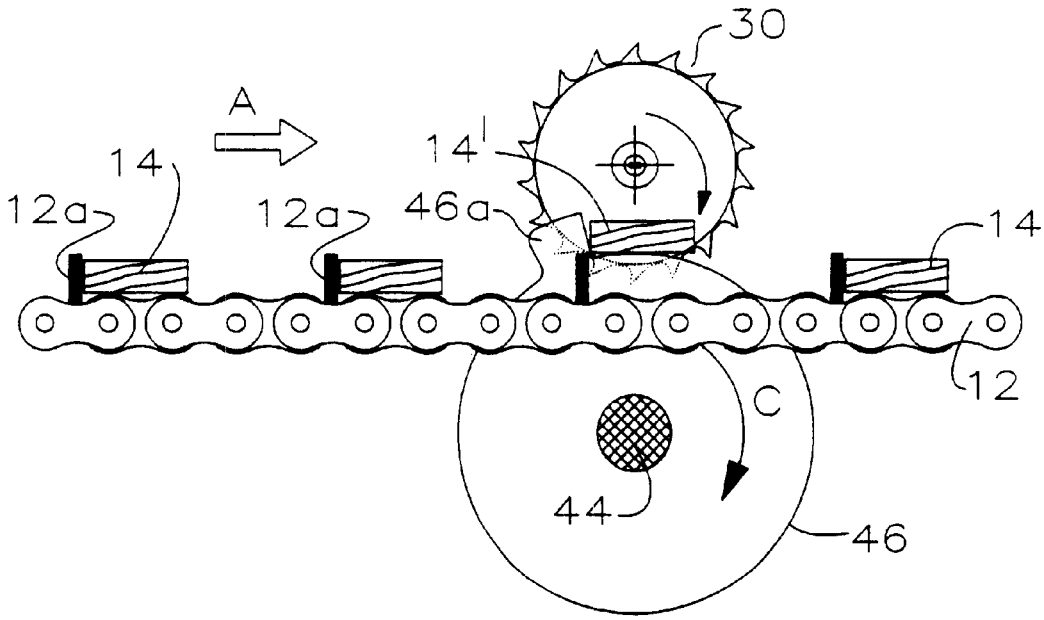
FIG. 4 is an enlarged sectional side elevation view of a board elevator elevating a board to be trimmed by a pre-trimmer saw.
Figure 5:
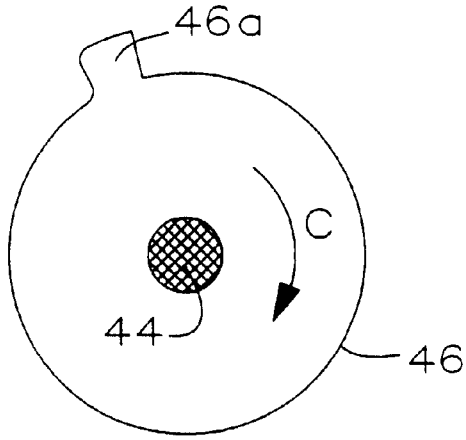
FIG. 5 is single-lugged board elevating wheel as seen in FIG. 4.
Figure 5A:
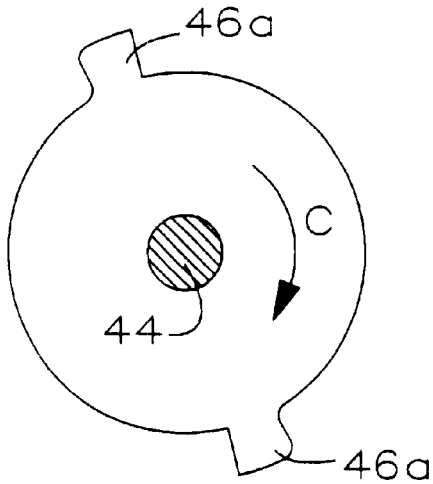
FIG. 5*a* is a double-lugged board-elevating wheel according to an alternative embodiment of the present invention.

As seen in FIGS. 4 and 5, a board elevator such as the laterally spaced apart array of lugged wheels 46, rotating in direction C on shaft 44, are sequenced or timed so that lugs 46*a* capture and rotationally elevate a single board 14'. The single board is elevated so that, with a pre-trimming saw 30 advanced into the flow path of the boards, that is, so as to extend into the flow path, past a vertical plane containing linear fixed fence 26, board 14' engages the pre-positioned saw 30 and is trimmed to leave a solid new end and to remove waste portion 14*a*'. Lugged wheels 46 may, as seen in FIG. 5*a* have an oppositely disposed pair of lugs 46*a*, which is not intended to be limiting so long as the lugs are rotated to capture successive boards 14 from the chain lugs.

Where two adjacent pre-trim saws 30 and 30' are employed, one upstream of the other, corresponding first and second board elevators 46 and 46' pick up sequentially alternative boards 14 to give each pre-trim saw 30 time to get to its next position. Thus the pre-trim saws have enough time to position for the worst case scenario, i.e. the furthest travel (the distance $D_{max}$ indicated in FIG. 1*a*) Thus a first board goes to a first pre-trim saw and second board i.e. every alternate one, goes to a second pre-trim saw, the upstream pre-trim saw merely having to retract only sufficiently towards the near-side to make way for the second pre-trim saw cut, i.e. not necessarily all the way out of the flow path.

Where the board elevator or elevators are vertically actuable, for example using light-weight board elevators which may be actuated, i.e. elevated and retracted, more quickly than actuation of drop-down saws, then it may not be necessary to extract the upstream pre-trim saw partially from flow path in order to allow the second pre-trim saw to make its scheduled optimized cut. In this instance a board scheduled for cutting by the second pre-trim saw is allowed merely to pass under the upstream pre-trim saw then is elevated into cutting engagement with the second pre-trim saw. Meanwhile, the upstream pre-trim saw is being pre-positioned to near-end trim the next scheduled board requiring an optimizing or near-end. An optimizing trim is, as better described below, a near-end trim which only partially removes near-end waste from a board, deliberately leaving a required board length so as to position far-end waste on the board for optimized trimming by one of the trimmer's far-end saws. When used in conjunction with an optimizer which also cooperates with a laterally pre-positionable ending saw, for example a P.E.T. saw, in or adjacent the multi-drop-down saw trimmer, then the near-end trim partially removed by the pre-trim saw can be completed by the ending saw.

Use of multiple pre-trim saws or a pre-trim saw or saws in conjunction with a downstream ending saw also provides a method of handling high board transfer rates where, for example, a lengthy near-end portion is to be removed but there is insufficient time between boards for the upstream pre-trim saw to translate in for the cut and then translate out to get out of the way of the next board. In such an instance, the upstream pre-trim saw may complete only a partial removal and a downstream saw would complete the removal of the near-end waste.

A further series of transverse ending rolls 36 are located downstream of the pre-trim saws. Rolls 36 urge the pre-trimmed near-end 14*a* of boards 14 against a fixed fence 38. Immediately downstream of fence 38 is a selectively movable edge trim ending or saw 40 which may be a P.E.T. saw generally co-axial or cooperating with a series of selectively actuable drop-down trim saws 42 within a multi-saw trimmer 20.

Selective saws of saws 42 are actuated, i.e. dropped down, to trim the far end 14*b* of each board 14. Due to the pre-trimming by saws 30 and ending by rolls 36 against fence 38, each board 14 has been positioned beneath trim saws 42 so that imperfections such as wane 14*c* at far end 14*b* of board 14 are trimmed by an optimal saw or saws 42 in multi-saw trimmer 20.

Figure 1A:
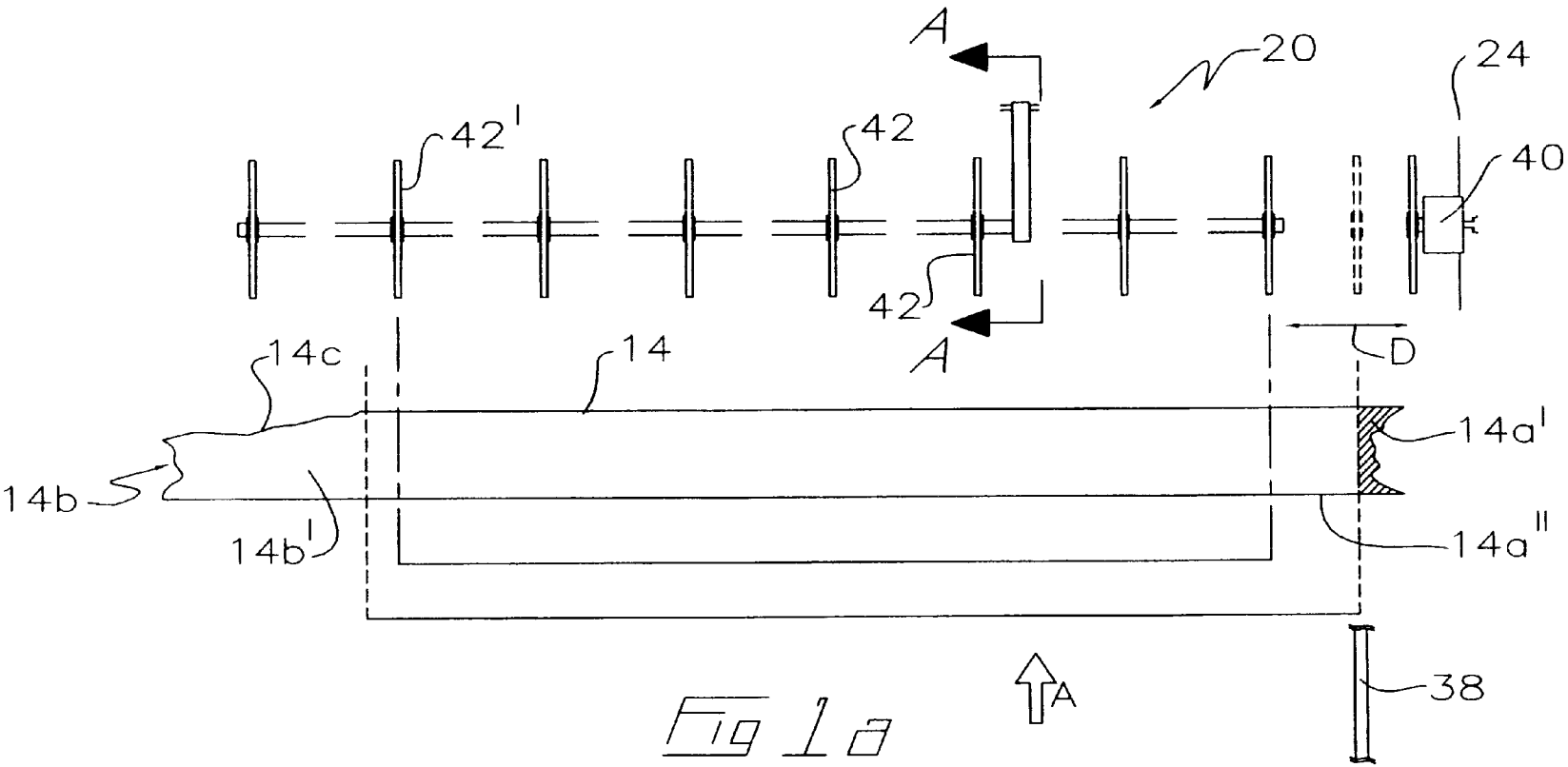
FIG. 1*a* is an enlarged plan view of a board entering the trimmer.
Figure 1B:
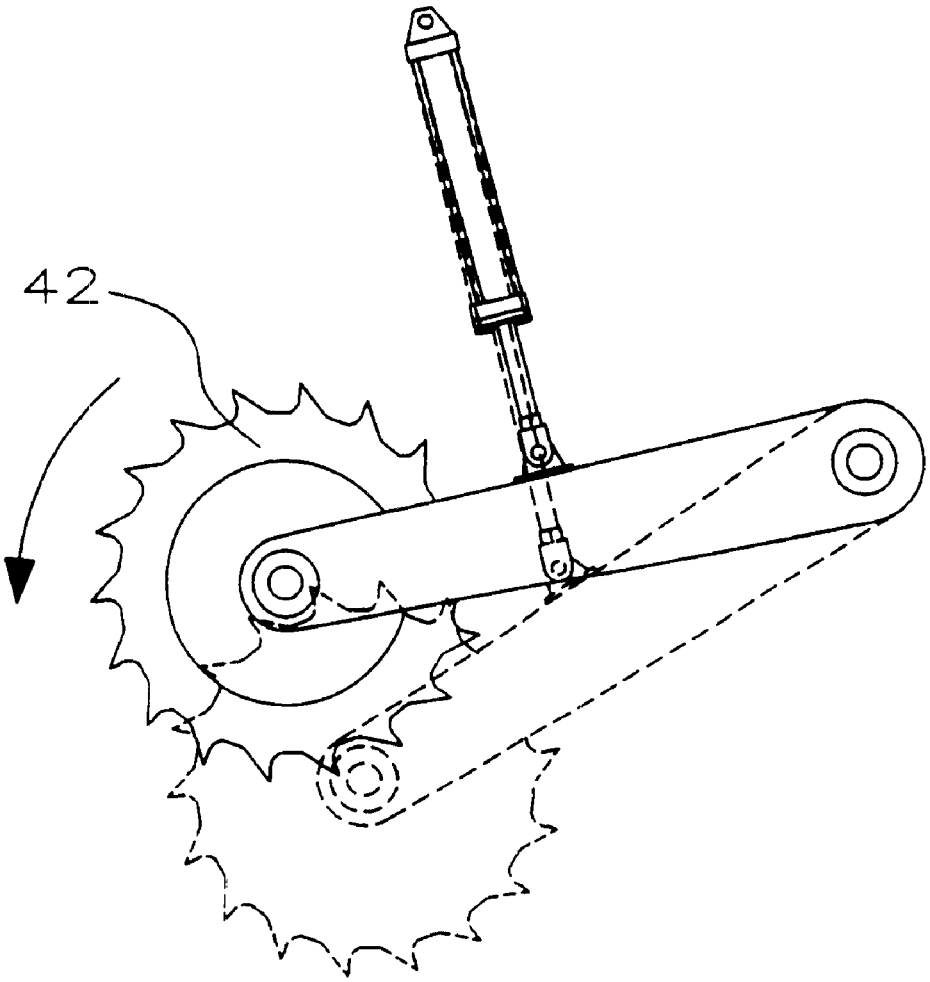
Fig 1b PRIOR ART
FIG. 1*b* is a view along line A—A in FIG. 1*a*.
Figure 2:
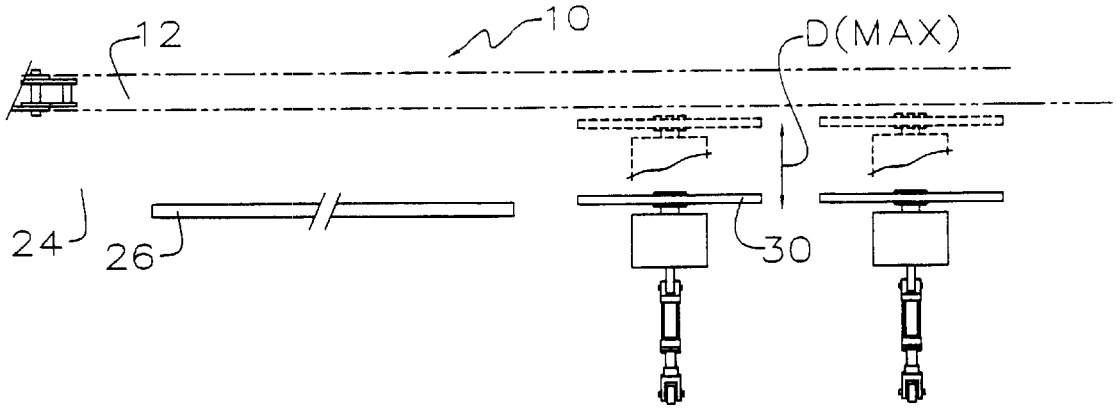
Figure 3:
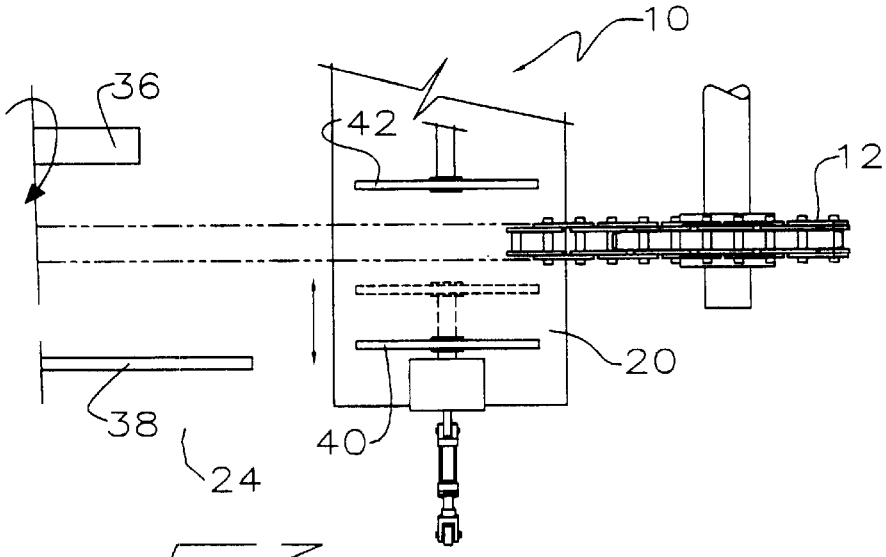

An ending saw 40 such as a P.E.T. saw, similar to saws 30 in the sense that the saw is selectively laterally translatable, may be provided to allow simultaneous double end trimming of a board 14 in trimmer 20 for improved accuracy and efficiency of board waste. In the embodiment where saw 40 is employed, the amount of pre-trimming of board near-end 14*a* is adjusted to allow for at least the thickness of a wafer cut and the kerf of saw 40. As seen in FIG. 1*a,* saw 40 may be used to accurately trim a further waste portion 14*a*" by positioning of saw 40 in direction D into the flow path of board 14. By setting pre-trimmer saws 30 to only trim a certain waste portion 14*a*', leaving a further waste portion 14*a*" to be trimmed by saw 40, far-end 14*b* of board 14 may be positioned accurately so that an optimal saw of drop-down saws 42 such as saw 42' seen in FIG. 1*a,* may trim an optimal amount of the waste, shown as waste portion 14*b*', from the far-end 14*b* of the board. In this fashion optimized trimming of both ends of board 14 may be accomplished and result in a board of any desired length with good accuracy.

The first trim, according to the present invention, is done in the sawmill (green end). The sawmill generally cuts with a 2 to 4 inch overlay called overtrim to allow for shrinkage in the drying process and end checking. The final shipping length is done in the planermill. All of the pieces in the planermill are trimmed generally ½ inch wager on the near end. The trimmer of the present invention will work in both the sawmill and the planermill.

The present invention can result in any desired length board measurement whether, imperial or metric. In the prior art this was done by installing one complete multi-saw trimmer with imperial saw spacing on all drop-saw ladders, for example, 24 inches, then another entire multi-saw trimmer downstream with metric spaced drop-saw ladders, for example, approximately 600 millimeters. The lateral pre-positioning on the pre-trim saws may be adjusted by the controller for optimized trimming no matter whether the boards are destined for the imperial or metric spacing drop saws.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A board trimmer having pre-trimmer saws comprising a selectively translatable upstream first pre-trimmer saw mounted on a near-side of a board flow path of a board transfer upstream of a downstream multi-saw board trimmer, said pre-trimmer saw selectively translatable by an actuator for translation linearly parallel to a near-side ended board on said board transfer, said pre-trimmer saw perpendicular to said board when on said board transfer, a board elevator mounted below said board flow path and said pre-trimmer saw for elevating said board from a sequence of single boards from said board transfer into sawing engagement with said pre-trimmer saw after said pre-trimmer saw has been pre-positioned by said actuator into a cutting path for optimized trimming of said board in said flow path according to an optimized solution for trimming said board, whereby said board is optimally trimmed by a combination of trimming a first waste portion from a near-end of said board by said first pre-trimmer saw and trimming a second waste portion from either or both of said near-end and a far end of said board by said downstream multi-saw trimmer.

2. The device of claim 1 wherein said board elevator comprises a rotatable disc having mounted thereon a means for carrying said board fixed relative to said disc as said disc rotates in a direction corresponding to said flow path and said board is carried over said disc, said disc parallel to said pre-trimmer saw and rotatably mounted below said board transfer so that only an upper periphery of said disc extends above said board transfer, said upper periphery rotating in said direction corresponding to said flow path.

3. The device of claim 2 wherein said board elevator is an array of said rotatable discs, said array of said rotatable discs extending across said flow path, parallel to said board when on said board transfer.

4. The device of claim 2 wherein said means for carrying said board fixed relative to said disc is at least one lug extending radially outwardly of said disc so as to extend upwardly from said upper periphery into engagement with an upstream side of said board as said board is carried over said upper periphery by rotation of said upper periphery.

5. The device of claim 4 wherein said at least one lug is a pair of oppositely disposed lugs.

6. The device of claim 2 further comprising a board scanner and a first board ending means mounted upstream of said first pre-trimmer saw so as to cooperate with boards in said flow path.

7. The device of claim 1 further comprising a selectively translatable second pre-trimmer saw mounted parallel to said first pre-trimmer saw and selectively translatable parallel to said selective translation of said first pre-trimmer saw, and wherein said board elevator is also below said second pre-trimmer saw.

8. The device of claim 7 wherein said second pre-trimmer saw is downstream on said flow path from said first pre-trimmer saw.

9. The device of claim 7 wherein said board elevator comprises a first rotatable disc corresponding to said first pre-trimmer saw and a second rotatable disc corresponding to said second pre-trimmer saw, said first and second rotatable discs having mounted thereon a means for carrying said board fixed relative to said first or second rotatable discs as said discs rotate in a direction corresponding to said flow path and said board is carried over said discs, said discs parallel to said pre-trimmer saws and rotatably mounted below said board transfer so that only an upper periphery of said discs extend above said board transfer, said upper periphery rotating in said direction corresponding to said flow path.

10. The device of claim 9 wherein said board elevator is a first array of spaced-apart said first rotatable discs and a second array of spaced-apart said second rotatable discs, said first and second arrays corresponding to said first and second pre-trimmer saws for elevating said board into said first or second pre-trimmer saws respectively, said first and second arrays extending across said flow path parallel to each other and to said board when on said board transfer.

11. The device of claim 9 wherein said means for carrying said board fixed relative to said discs is at least one lug extending radially outwardly of said discs so as to extend upwardly from said upper periphery into engagement with an upstream side of said board as said board is carried over said upper periphery by rotation of said upper periphery.

12. The device of claim 11 wherein said at least one lug is a pair of oppositely disposed lugs.

13. The device of claim 9 further comprising a board scanner and a first board ending means mounted upstream of said first pre-trimmer saw so as to cooperate with boards in said flow path.

14. The device of claim 7 further comprising, in combination, a selectively laterally translatable ending saw downstream of said first and second pre-trimmer saws and mounted on said near-side of said board flow path, said ending saw selectively actuable by an ending saw actuator to extend said ending saw into said flow path to trim a selectively optimized end portion from said board as said board passes into said multi-saw saw trimmer, said ending saw cooperating with said first and second pre-trimmer saws to allow for optimized trimming of a far-end waste portion of said second waste portion from said board during selective sawing by saws of said multi-saw board trimmer, said far-end waste portion opposite said near end of said board, wherein said board is a near-side ended board near-side ended between said first and second pre-trimmer saws and said ending saw.

15. The device of claim 14 further comprising a board scanner and a first board ending means mounted upstream of said first and second pre-trimmer saws and a second board ending means mounted between said first and second pre-trimmer saws and said ending saw so as to cooperate with boards in said flow path.

16. The device of claim 7 further comprising a board scanner and a first board ending means mounted upstream of said first pre-trimmer saw so as to cooperate with boards in said flow path.

17. The device of claim 1 further comprising, in combination, a selectively laterally translatable ending saw downstream of said first pre-trimmer saw and mounted on said near-side of said board flow path, said ending saw selectively actuable by an ending saw actuator to extend said ending saw into said flow path to trim a selectively optimized end portion from said board, said ending saw cooperating with said first pre-trimmer saw to allow for optimized trimming of a far-end waste portion of said second waste portion from said board during selective sawing by saws of said multi-saw board trimmer, said far-end waste portion opposite said near end of said board, wherein said board is a near-side ended board near-side ended between said first pre-trimmer saw and said ending saw.

18. The device of claim 17 further comprising a board scanner and a first board ending means mounted upstream of said first pre-trimmer saw and a second board ending means mounted between said first pre-trimmer saw and said ending saw so as to cooperate with boards in said flow path.

19. The device of claim 1 further comprising a board scanner and a first board ending means mounted upstream of said first pre-trimmer saw so as to cooperate with boards in said flow path.

* * * * *